United States Patent [19]

Stöckel et al.

[11] 4,354,075

[45] Oct. 12, 1982

[54] ELECTRICAL CONTACT ELEMENT AND PROCESS FOR ITS MANUFACTURE

[75] Inventors: Dieter Stöckel, Birkenfeld; Hans H. Kocher, Pforzheim-Dillweissenstein, both of Fed. Rep. of Germany

[73] Assignee: G. Rau, Pforzheim, Fed. Rep. of Germany

[21] Appl. No.: 192,841

[22] Filed: Oct. 1, 1980

Related U.S. Application Data

[63] Continuation-in-part of Ser. No. 22,358, Mar. 20, 1979, abandoned.

[30] Foreign Application Priority Data

Mar. 25, 1978 [DE] Fed. Rep. of Germany ..... 2813087

[51] Int. Cl.[3] ..... H01H 1/02

[52] U.S. Cl. ..... 200/262; 75/229; 428/549; 428/567; 428/608

[58] Field of Search ..... 428/608, 549, 567; 75/229; 200/262, 265

[56] References Cited

U.S. PATENT DOCUMENTS

| | | | |
|---|---|---|---|
| 2,295,338 | 9/1942 | Ely | 200/262 |
| 3,401,024 | 9/1968 | Holt et al. | 75/247 |
| 3,459,915 | 8/1969 | Swazy et al. | 75/247 |
| 3,889,348 | 6/1975 | Lemelson | 75/229 |
| 4,021,633 | 5/1977 | Kuwabara et al. | 200/262 |
| 4,032,301 | 6/1977 | Hassler et al. | 428/567 |

FOREIGN PATENT DOCUMENTS

| | | | |
|---|---|---|---|
| 559317 | 6/1958 | Canada | 75/229 |

*Primary Examiner*—John W. Shepperd

*Attorney, Agent, or Firm*—Wenderoth, Lind & Ponack

[57] ABSTRACT

An electrical contact element is made of material which is resistant to metal migration and which contains a major proportion by weight, at least two metallic components which are soluble in each other and form a composite material. At least one of the components consists of a noble metal, and the metallic components are heterogeneously embedded in the composite material as pure metallic components. A process for making such a contact element comprises forming jacket wires, made of the metallic components, into clusters and metallurgically joining the wires by plastic shaping to form the composite material.

7 Claims, 4 Drawing Figures

ELECTRICAL CONTACT ELEMENT AND PROCESS FOR ITS MANUFACTURE

This application is a continuation-in-part application of Ser. No. 22,358 which was filed Mar. 20, 1979, now abandoned.

BACKGROUND OF THE INVENTION

The invention relates to an electrical contact element and to a process for its manufacture.

In electrical switching contacts and particularly when direct current is applied thereto, metal migration occurs at the contact faces, which migration causes, in known contact materials, the formation of pronounced peaks and craters which can lead to premature destruction of the contact element. This migration of material, which usually proceeds from the anode to the cathode, is a property that depends upon the structure of the contact material and upon the way the metallic components are embedded.

AuCo and PdCu alloys are known as contact materials that resist metal migration. A disadvantage of these materials is that they are required to contain a relatively large amount of noble metal, since the structure necessary for providing the required properties can be obtained only if the contact material contains a certain proportion of noble metal, as shown by the equilibrium diagrams of the alloys concerned. These alloys, resistant to metal migration, in which the metallic components are present in a thermodynamically stable ordered or heterogeneous condition as shown by the equilibrium diagram, additionally exhibit poor workability which in the case, for example, of the production of clad electrical contact rivets having a contact layer consisting of the alloy PdCu 60/40, necessitates an expensive cladding process.

SUMMARY OF THE INVENTION

The present invention seeks to provide an electrical contact element which is made of a material resistant to metal migration and which, while containing a relatively small amount of noble metal, has good workability and, in particular, can be readily welded to contact carriers. According to the invention, there is provided an electrical contact element made of material resistant to metal migration and which contains in a major proportion by weight, at least two metallic components which are soluble in each other and which form a composite material, at least one of such components consisting of a noble metal, and wherein the metallic components are heterogeneously embedded in the composite material as pure metallic components.

Surprisingly, it has been found that such composite materials, which are thus present in a thermodynamically unstable condition, exhibit little material migration compared to the corresponding homogeneous alloys (mixed crystals of like composition). The composite material which contains, as a multiphase material, the components concerned in a metallurgically pure form, has the additional advantages of possessing greater electrical and thermal conductivity than the homogeneous mixed crystal.

The metallic components can be expediently embedded in a heterogenous manner if the composite material is a fiber composite material containing, in the form of a matrix and fibers, the components that are soluble in each other. It appears to be expedient to embed in this material a large number of fibers, the diameter of which is in the order of magnitude of from 0.001 to 0.1 mm. Use can be made of fibers, all of which are of the same diameter, though for certain applications, fibers having different diameters can be advantageously used.

The noble metal content can be between 8% by weight and 70% by weight, depending upon requirements.

Instead of a fiber composite material, it appears to be expedient to use other composite materials having a heterogeneous distribution of the components soluble in each other in which substances there are embedded, particularly in the matrix component, metallic inclusions of the other component in, for example, spheroidal or granular form.

In the case of a fiber composite material, an apparently advantageous arrangement appears to be one in which uniformly extending fibers, which can number more than 500, disposed substantially parallel in the longitudinal direction, are present.

In addition to the two metallic components, soluble in each other, one at least of which consists of a noble metal, other metallic and/or non-metallic components in smaller proportions can also be embedded in the contact material in certain instances. For certain applications, it appears expedient to embed longitudinal strands of metal components such as $SnO_2$, or of graphite, in the contact material.

The components, soluble in each other, of the contact material resistant to metal migration can be expediently used in various combinations, for example copper/palladium and palladium/silver.

A process for the production of a contact element according to the invention includes forming jacket wires made of the metallic components into clusters wherein the wires are arranged in parallel, and metallurgically joining the wires by plastic shaping to form the composite material.

In an embodiment of the invention, solid wires, which are originally bundled in parallel, are plastically shaped jointly with the jacket wires, which solid wires consist of the already present components soluble in each other, and/or of additional components.

In an alternative form of the production process, it may be expedient for some purposes to subject the components soluble in each other to joint plastic shaping in the form of solid wires and to unite them metallurgically to each other by drawing or rolling processes, for example.

During the production process, care has to be taken to ensure that the reciprocal diffusion of the heterogeneously distributed components, and particularly the diffusion of the fibers and the matrix, is kept within the necessary limits. Diffusion causes the formation of mixed crystals and runs counter to the required purely heterogeneous distribution. In this connection, diffusion-inhibiting intermediate layers may be used in some instances for coating one of the metallic components embedded in the matrix.

Apart from fiber composite materials having a copper matrix and palladium fibers, it appears that use can also be made of such materials having a silver matrix, or matrices of copper and silver alloys. With a low noble-metal content of from approximately 8 to 50% by weight of Pd, good workability of the fiber composite materials obtained therewith is observed. These materials can be processed by the usual hot and cold welding automatic machines in a simple and inexpensive manner to form bimetallic rivets without altering the parameters of the process.

DETAILED DESCRIPTION OF THE INVENTION

The accompanying drawings illustrate, on an enlarged scale, contact rivets made in accordance with the present invention, and each having a contact surface 2 made of a fiber composite material wherein palladium fibers 4, disposed parallel in the longitudinal direction, are embedded in a copper matrix material 6 and extend substantially at right-angles to the contact face 2, and are metallurgically united with the matrix material 6.

Figure 1:
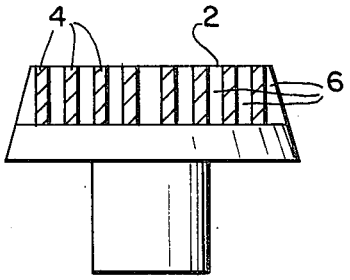
FIGS. 1–3 are elevation views, on an enlarged scale and partially sectioned, of contact rivets according to the invention.

FIG. 1 shows an arrangement wherein fibers 4 have equal cross-sections.

Figure 2:
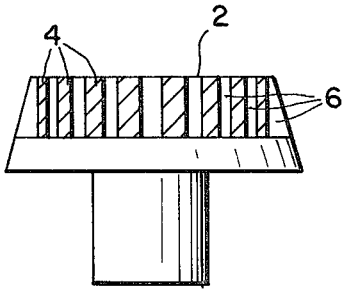

FIG. 2 shows a modification wherein fibers 4 have different cross-sections.

Figure 3:
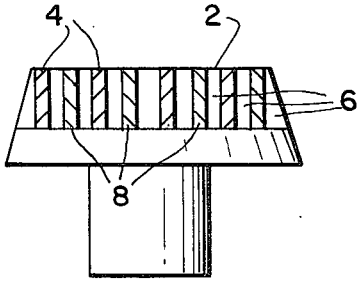
Figure 4:
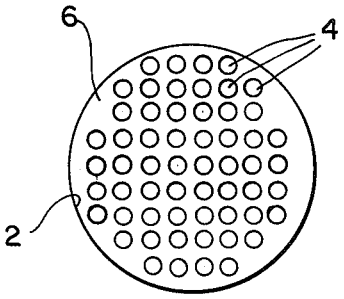
FIG. 4 is a top plan view of the rivet of FIG. 1.

FIG. 3 shows an additional feature of the present invention wherein the composite material further includes continuous strands 8 of a metallic compound material or graphite material.

There has been described an electrical contact element made of material resistant to metal migration and which, while having a small noble-metal content, combines favorable electrical properties with high thermal conductivity and good workability.

EXAMPLE I

A contact element made of the material CuPd 33, forming a fiber composite material, was produced by the bundling of 750 jacket wires initially in parallel relationship to each other and plastically shaping them, by drawing, jointly. The jacket wires having a diameter of approximately 2 mm and consisting of a palladium core and a copper jacket, of suitable composition (67% by weight Cu, 33% by weight Pd), the drawing being carried out in several, e.g. ten, passes. Using standard cold-shaping methods, electrical contact rivets were produced from this material which are resistant to metal migration.

Testing was carried out in commercially-available relays using 14 V direct current and with switching circuit inductances of 1 to 150 mH. With the switching conditions being varied in the usual way, slight burning of the contact parts, confined entirely to the surface and involving no formation of peaks and craters was observed, contact resistance being consistently low. On the other hand, materials of the same composition in the thermodynamically stable homogeneous condition, as shown in the equilibrium diagram (single-phase alloys) had, after being subjected to the same loading, a marked pitted appearance accompanied by increased losses due to burning.

EXAMPLE II

A contact element, as in Example I, was processed by a standard automatic hot-welding method to form clad contact rivets having copper stems. Homogeneous materials of the same composition could not be satisfactorily connected to the copper stem. Testing under an electrical switching load gave the same results as in Example I.

We claim:

1. An electrical contact element formed of composite material which is resistant to metal migration during use including, in a major proportion by weight, at least copper and palladium which are soluble in each other, which are heterogeneously combined in said composite material, said composite material being a fiber composite material including said copper component in the form of a matrix and said palladium component in the form of a large number of uniformly extending fibers which are embedded and metallurgically bonded to said copper matrix and which extend substantially entirely through said matrix, said fibers and said matrix having been produced by joint plastic shaping of a bundle of copper coated palladium wires which are initially arranged in parallel orientation to each other, the diameter of said fibers being from 0.001 to 0.1 mm with the fibers substantially at right-angle to the contact surface in the finished product.

2. An electrical contact element formed of composite material which is resistant to metal migration during use including, in a major proportion be weight, at least silver and palladium which are soluble in each other, which are heterogeneously combined in said composite material, said composite material being a fiber composite material including said silver component in the form of a matrix and said palladium component in the form of a large number of uniformly extending fibers which are embedded and metallurgically bonded to said silver matrix and which extend substantially entirely through said matrix, said fibers and said matrix having been produced by joint plastic shaping of a bundle of silver coated palladium wires which are initially arranged in parallel orientation to each other, the diameter of said fibers being from 0.001 to 0.1 mm with the fibers substantially at right-angle to the contact surface in the finished product.

3. A contact element as in claim 1 or 2, wherein said fibers are all of equal cross-section.

4. A contact element as in claim 1 or 2, wherein some of said fibers have cross-sections different from others of said fibers.

5. A contact element as in claim 1 or 2, wherein said composite material further comprises continuous strands of metallic compound material embedded therein and disposed parallel to each other in the longitudinal direction.

6. A contact element as in claim 1 or 2, wherein said composite material further comprises continuous strands of graphite material embedded therein and disposed parallel to each other in the longitudinal direction.

7. A contact element as in claim 1 or 2, wherein the number of said fibers is greater than 500.

* * * * *